US008526657B2

(12) United States Patent
Yanagishita et al.

(10) Patent No.: US 8,526,657 B2
(45) Date of Patent: Sep. 3, 2013

(54) HEADPHONE SET

(75) Inventors: Yuji Yanagishita, Yokohama (JP); Shinnosuke Katsuyama, Yokohama (JP)

(73) Assignee: JVC Kenwood Corporation, Yokohama-Shi, Kanagawa (JP)

( * ) Notice: Subject to any disclaimer, the term of this patent is extended or adjusted under 35 U.S.C. 154(b) by 910 days.

(21) Appl. No.: 12/590,416

(22) Filed: Nov. 9, 2009

(65) Prior Publication Data

US 2010/0166204 A1 Jul. 1, 2010

(30) Foreign Application Priority Data

Dec. 26, 2008 (JP) ..... 2008-333420

(51) Int. Cl.
*H04R 25/00* (2006.01)

(52) U.S. Cl.
USPC ..... 381/375; 381/380

(58) Field of Classification Search
USPC ..... 381/170, 330, 375, 381, 382; 379/430, 379/433
See application file for complete search history.

(56) References Cited

U.S. PATENT DOCUMENTS 5,138,664 A * 8/1992 Kimura et al. ..... 381/71.6
5,363,444 A * 11/1994 Norris ..... 379/430
5,373,555 A * 12/1994 Norris et al. ..... 379/430
5,732,143 A * 3/1998 Andrea et al. ..... 381/71.6
6,647,368 B2 * 11/2003 Nemirovski ..... 704/270
7,864,974 B2 * 1/2011 Chen ..... 381/345
8,098,838 B2 * 1/2012 Lee et al. ..... 381/74
8,130,995 B2 * 3/2012 Her et al. ..... 381/380
2009/0285436 A1 * 11/2009 Lowry ..... 381/380

FOREIGN PATENT DOCUMENTS

JP 5-36991 5/1993
JP 7-42300 7/1995
JP 2001-211491 8/2001
JP 2008-301376 12/2008

* cited by examiner

*Primary Examiner* — Mohammad Islam
*Assistant Examiner* — Phylesha Dabney
(74) *Attorney, Agent, or Firm* — Renner, Kenner, Greive, Bobak, Taylor & Weber

(57) ABSTRACT

A headphone set is equipped with left- and right-ear headphone units. Each unit includes a housing body having a first plane section and a second plane section that faces the first section, the sections being almost perpendicular to a cross section of a cavum conchae of a user's ear when the housing body is fit in the cavum conchae, a speaker and a microphone aligned between the sections, the speaker being located at the first section side, the microphone being located at the second section side. A sound output section is provided at the first section, to give off sounds output by the speaker to an outer space of the housing body. A sound pick-up hole is provided at the second section, through which the outer space communicates with an inner space of the housing body created between a sound pick-up section of the microphone and the second section.

9 Claims, 9 Drawing Sheets

HEADPHONE SET

CROSS-REFERENCE TO RELATED APPLICATIONS

This application is based on and claims the benefit of priority from the prior Japanese Patent Application No. 2008-333420 filed on Dec. 26, 2008, the entire contents of which is incorporated herein by reference.

BACKGROUND OF THE INVENTION

The present invention relates to headphone sets, and, especially, so-called an inner-ear type headphone set to be fit in the auricles of user's ears, equipped with a microphone installed in a headphone housing to pick up ambient sounds.

A noise-canceling headphone set having a noise-canceling function, which is now very popular, is one of the known headphone sets equipped with a microphone installed in a headphone housing to pick up ambient sounds.

One type of the noise-canceling headphone set is equipped with a microphone installed in a headphone housing to pick up ambient sounds through openings made in the housing. When the ambient sounds are picked up, signals are generated as having the reverse phase of the ambient sounds and combined with audio signals to be listened, and output to user's ears via speakers.

The noise-canceling mechanism cancels the ambient sounds almost completely, that pass through the gap between the headphone housing and user's ears or the housing itself to reach the user's ears. With this mechanism, users can enjoy sounds reproduced from audio signals to be listened with almost no effects of the ambient sounds.

With increased use of headphone sets for listening music in daily life, not only an overhead type with a headband to be put on the user's head, but also an inner-ear type to be inserted into the auricles of user's ears has been very popular now, as noise-canceling headphone sets.

The inner-ear type headphone sets include a canal type equipped with a cylindrical sound output tube installed in a headphone housing and attached with a rubber ear piece. The sound output tube is inserted into the canal of a user's ear so that the ear piece touches the inner wall of the canal.

Shown in FIG. 1 is an appearance of a known inner-ear type noise-canceling headphone set.

Installed in a housing 104 are a speaker unit 102 and a microphone 103 aligned along a drive axis CL101 of the speaker unit 102. Provided on the back of the housing 104 are sound pick-up holes 104*a* through which ambient sounds are picked up by the microphone 103. A sound output tube 105 is attached to the housing 104 as protruding in the opposite direction of the microphone 103.

The sound output tube 105 is covered with an ear piece 106. In use of the headphone set, the ear piece 106 is inserted into the canal of a user's ear so that the housing 104 is attached inside the auricle of the user's ear.

The known inner-ear type noise-canceling headphone set has several disadvantages as discussed below.

The housing 104 is large as indicated by allows L101 in FIG. 1, so that the part of the housing 104 provided with the sound pick-up holes 104*a* protrudes from a user's ear. This structure allows window noises to be picked up by the microphone 103, thus posing a difficulty in picking up ambient sounds efficiently.

When the window noises are picked up by the microphone 103, the noises could be amplified and output via a speaker, after undergoing a noise-canceling procedure.

The microphone 103 is provided as apart from the ear piece 106, with the speaker 102 interposed therebetween, as shown in FIG. 1. The arrangement has the center of gravity far from the ear piece 106, thus users could not enjoy fitability to his or her ears and the ear piece 106 could easily be out of position due to user body movements.

SUMMARY OF THE INVENTION

A purpose of the present invention is to provide an inner-ear type headphone set equipped with a microphone, installed in a headphone housing, to pick up ambient sounds, achieving high fitability to auricles of user's ears with almost no effects of wind noises.

The present invention provides a headphone set comprising: a housing body having a first plane section and a second plane section that faces the first plane section, the first and second plane sections being almost perpendicular to a cross section of a cavum conchae of a user's ear when the housing body is fit in the cavum conchae, a speaker and a microphone aligned between the first and second plane sections, the speaker being located at the first plane section side, the microphone being located at the second plane section side; a sound output section provided at the first plane section, to give off sounds output by the speaker to an outer space of the housing body; a sound pick-up hole provided at the second plane section, through which the outer space communicates with an inner space of the housing body created between a sound pick-up section of the microphone and the second plane section.

DETAILED DESCRIPTION OF PREFERRED EMBODIMENT

A preferred embodiment of a headphone set according to the present invention will be described with reference to the attached drawings.

Figure 1:
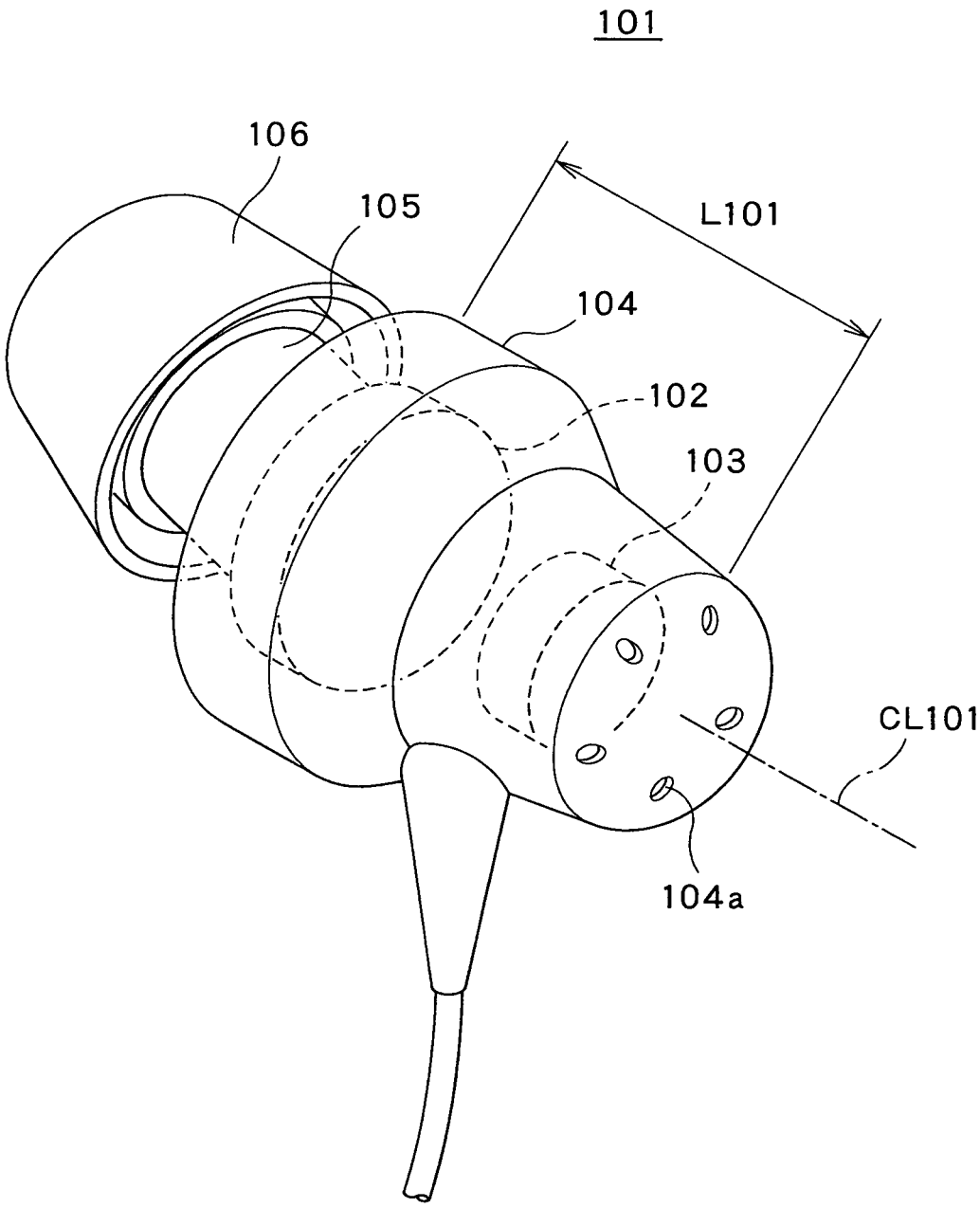
FIG.1 (PRIOR ART)
FIG. 1 shows an appearance of a known inner-ear type noise-canceling headphone set.
Figure 2:
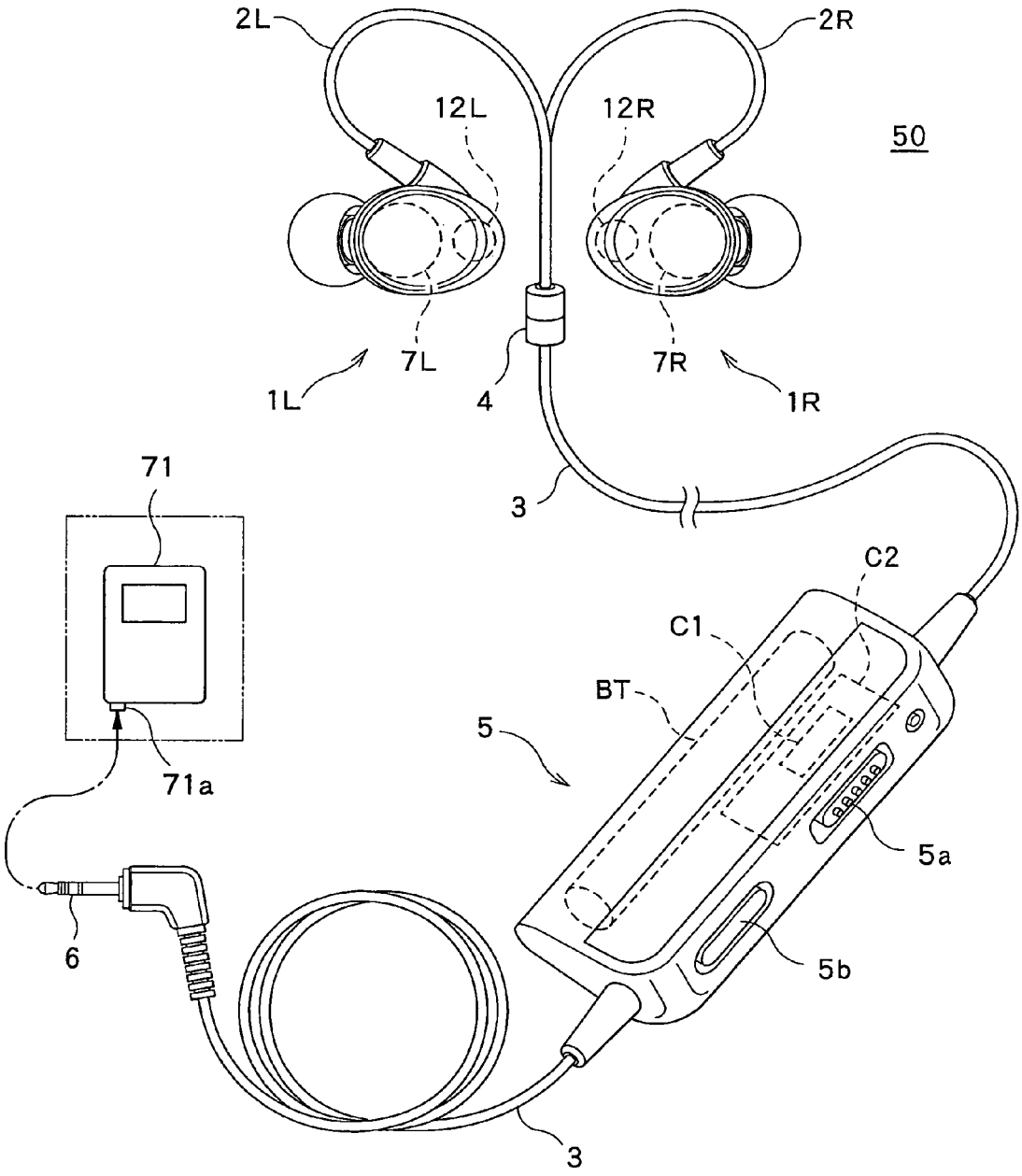
FIG. 2 shows an appearance of a canal-type headphone set having a noise-canceling function, a preferred embodiment according to the present invention.

Illustrated in FIG. 2 is an appearance of a canal-type headphone set 50 having a noise-canceling function, a preferred embodiment according to the present invention.

The headphone set 50 is equipped with: a left-ear headphone unit 1L; a right-ear headphone unit 1R; cords 2L and 2*r* pulled out from the units 1L and 1R, respectively; a coupler 4 that couples the two cords 2L and 2*r* into a single connection cord 3; an operation unit 5 provided in-between the connection cord 3 and another connection cord 3; and a plug 6 provided at the end of the other connection cord 3.

Installed in the headphone units 1L and 1R are speaker 7L and 7R for sound output, and microphones 12L and 12R for picking up ambient sounds, respectively. The speakers 7L and 7R, and the microphones 12L and 12R have an almost flat cylindrical shape.

Installed in the operation unit 5 are a printed circuit board C2 mounted on which is an electronic circuit C1 having a noise-canceling function, and a detachable battery BT, such as, a size AAA battery, as a power supply for the electronic circuit C1.

Provided to the operation unit 5 are a switch 5*a* to switch the noise-canceling function and a button 5*b* to pause the noise-canceling function for listening mainly ambient sounds.

When the headphone set 50 is used for, for example, listening music from an external music reproduction apparatus 71, the plug 6 is connected to an audio output terminal 71*a* of the apparatus 71.

When the noise-canceling function is turned off by the switch 5*a* of the operation unit 5 while the headphone set 50 is being used with the music reproduction apparatus 71, an audio signal sent from the apparatus 71 via the plug 6 is supplied to the headphone units 1L and 1R through the connection cords 3, the operation unit 5, and the cords 2L and 2*r*. Thus, sounds based on the audio signal is output from the speakers 7L and 7R.

On the contrary, when the noise-canceling function is turned on by the switch 5*a*, ambient sounds are picked up by the microphones 12L and 12R through a pick-up opening 8*g* (not shown in FIG. 2 and which will be described later). The microphones 12L and 12R generate left and right ambient-sound audio signals that carry the ambient sounds.

The left and right ambient-sound audio signals are supplied to the electronic circuit C1 of the operation unit 5. The electronic circuit C1 generates left and right canceling signals that have the reverse phase of the left and right ambient-sound audio signals, respectively. Then, the electronic circuit C1 adds the left and right canceling signals to left and right audio signals supplied from the music reproduction apparatus 71, respectively, to produce left and right noise-canceling audio signals.

The left and right noise-canceling audio signals are supplied to the speakers 7L and 7R, respectively. The speakers 7L and 7R output sounds based on the left and right noise-canceling audio signals, which cancel or reduce ambient sounds that reach the user's ears from outside the headphone set 50. Thus, the user can enjoy the music from the external music reproduction apparatus 71, without being bothered by ambient noises.

Described next is the left-ear headphone unit 1L of the headphone set 50. The description is also applied to the right-ear headphone unit 1R of the headphone set 50 because the units 1L and 1R have the symmetrical structures.

Figure 3:
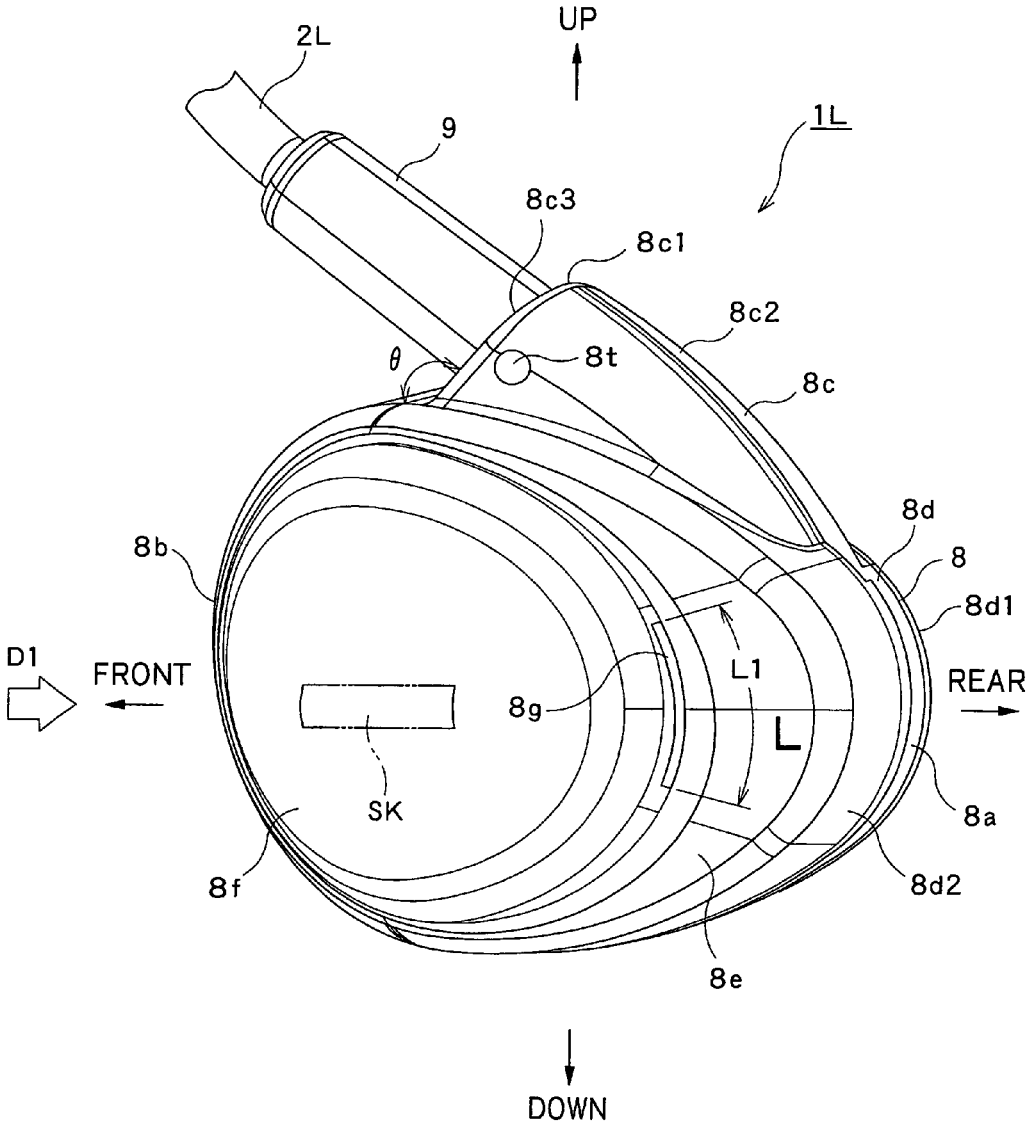
FIG. 3 is a perspective view of an appearance of a left-ear headphone unit when fit in the auricle of the user's left ear, according to the present invention.

FIG. 3 shows a perspective view of an appearance of the left-ear headphone unit 1L when fit in the auricle of the user's left ear.

The arrows with signs FRONT and REAR indicate the directions of the front and rear sides of the user's head, respectively, when the left-ear headphone unit 1L is inserted into the auricle of the user's left ear. The arrows with signs UP and DOWN indicate the user's parietal and neck sides, respectively, when the unit 1L is fit in the auricle of the user's left ear.

The left-ear headphone unit 1L has an egg-shaped housing body 8 having a small-radius section 8*a* having a smaller radius in the direction of REAR and a large-radius section 8*b* having a larger radius in the direction of FRONT when viewed from outside indicated by an arrow D1. The unit 1L is longer in the directions of REAR and FRONT than UP and DOWN.

Provided on the housing body 8 in the direction of UP is a protruding member 8*c* that protrudes from the housing body 8 obliquely and upwardly. The protruding member 8*c* has an asymmetrical triangle shape with a summit section 8*c*1 that protrudes most from the housing body 8, when viewed from D1. The direction of the arrow indicated by D1 is substantially orthogonal to the outer surface of an ornament cap 8*f* which will be described later.

The protruding member 8*c* is constituted by the summit section 8*c*1 described above, a first oblique section 8*c*2 having a ridge that is gently joined to the outer curved line of the small-radius section 8*a*, and a second oblique section 8*c*3 that joins the summit section 8*c*1 and the large-radius section 8*b* at an angle θ so that the section 8*c*3 steeply rises from the section 8*b*.

Pulled out upwardly from the second oblique section 8*c*3 is the cord 2L that is covered with a rubber bushing 9 at an end thereof at the protruding member 8*c* side, for high flexibility.

A protrusion 8*t* is formed on the protruding member 8*c* of the left-ear headphone unit 1L only so that a user can distinguish the left- and right-ear headphone units 1L and 1R by the touch.

The egg-shaped housing body 8 is constituted by a main housing 8*d*, an ornament ring 8*e* fixed to the housing 8*d*, and the ornament cap 8*f* (described above) fixed to the ring 8*e* as covering the opening of the ring 8*e*. The main housing 8*d* and the ornament ring 8*e* or the ornament cap 8*f* and the ring 8*e* may be formed as one member.

The main housing 8*d* is constituted by an inner housing 8*d*1 and an outer housing 8*d*2. The inner housing 8*d*1 is located at the user's head (or ear) side when the left-ear headphone unit 1L is inserted into the auricle of the user's left ear.

The main housing 8*d*, the ornament ring 8*e*, and the ornament cap 8*f* can be formed by resin injection molding with ABC (Acrylonitrile Butadiene Styrene) resin, PS (Polystyrene) resin, etc.

The ornament ring 8*e* is painted according to design, provided with the letter L by silk printing for the left-ear headphone unit 1L so that a user can distinguish both units 1L and 1R.

The ornament cap 8*f* is provided with a manufacturer logo and/or a serial number, by silk printing, in a zone SK indicated by a double-dashed dotted line.

Provided at a part of the border between the ornament ring 8*e* and cap 8*f* is a sound pick-up opening 8*g* formed in a slit with an arc length L1, which will be described later in detail.

Figure 4:
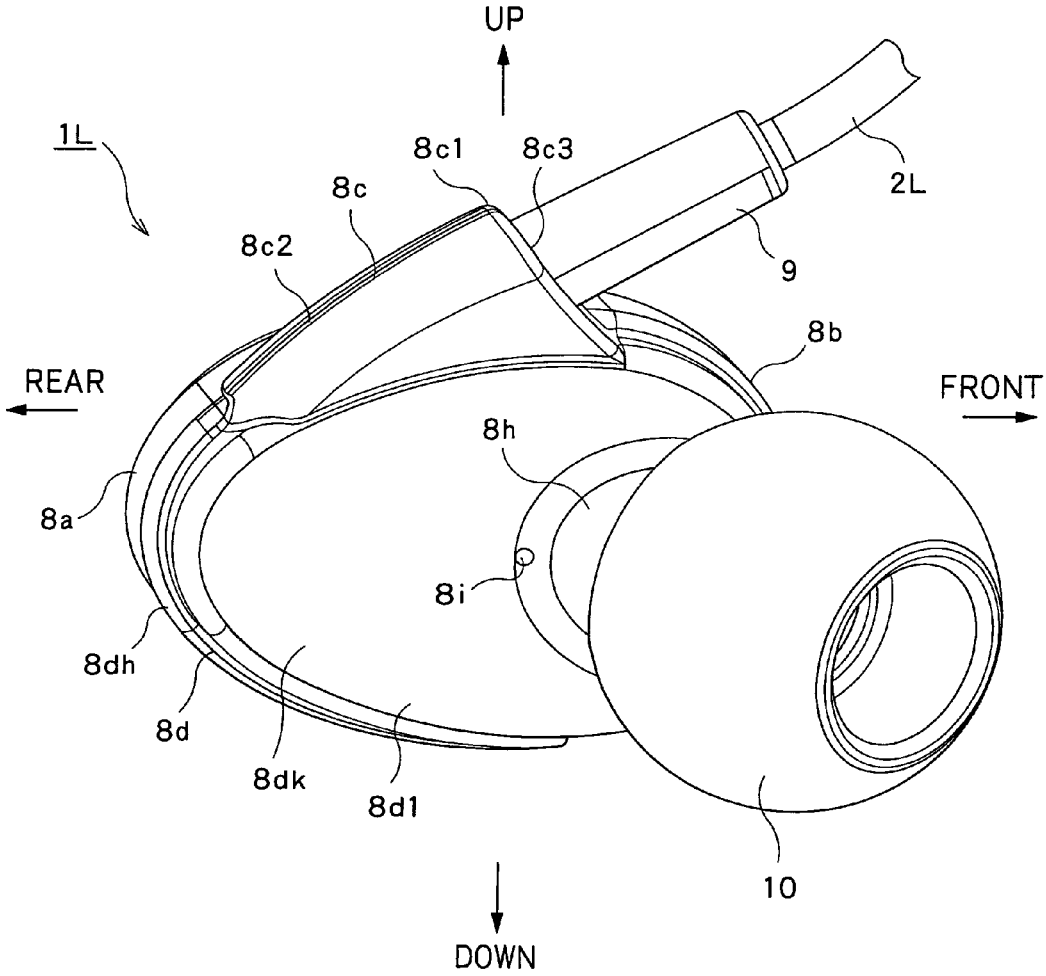
FIG. 4 is a perspective view of an appearance of the left-ear headphone unit when viewed from the user's left-ear auricle side, according to the present invention.

The left-ear headphone unit 1L is described further with reference FIG. 4 that shows a perspective view of an appearance of the unit 1L when viewed from the user's left-ear auricle side. The arrows with the signs FRONT, REAR, UP and DOWN indicate the same directions as shown in and defined with respect to FIG. 3.

In FIG. 4, the inner housing 8*d*1 is constituted by a substantially flat egg-like base member 8*dk* and a wall member 8*dh* that stands as surrounding the base member 8*dk*.

Attached to the base member 8*dk* in the large-radius section 8*b* side, obliquely in the direction the ear canal of the user's left ear, is a sound output tube 8*h* provided with a rubber ear piece 10 at its end. The ear piece 10 is detachable by a user.

Figure 7:
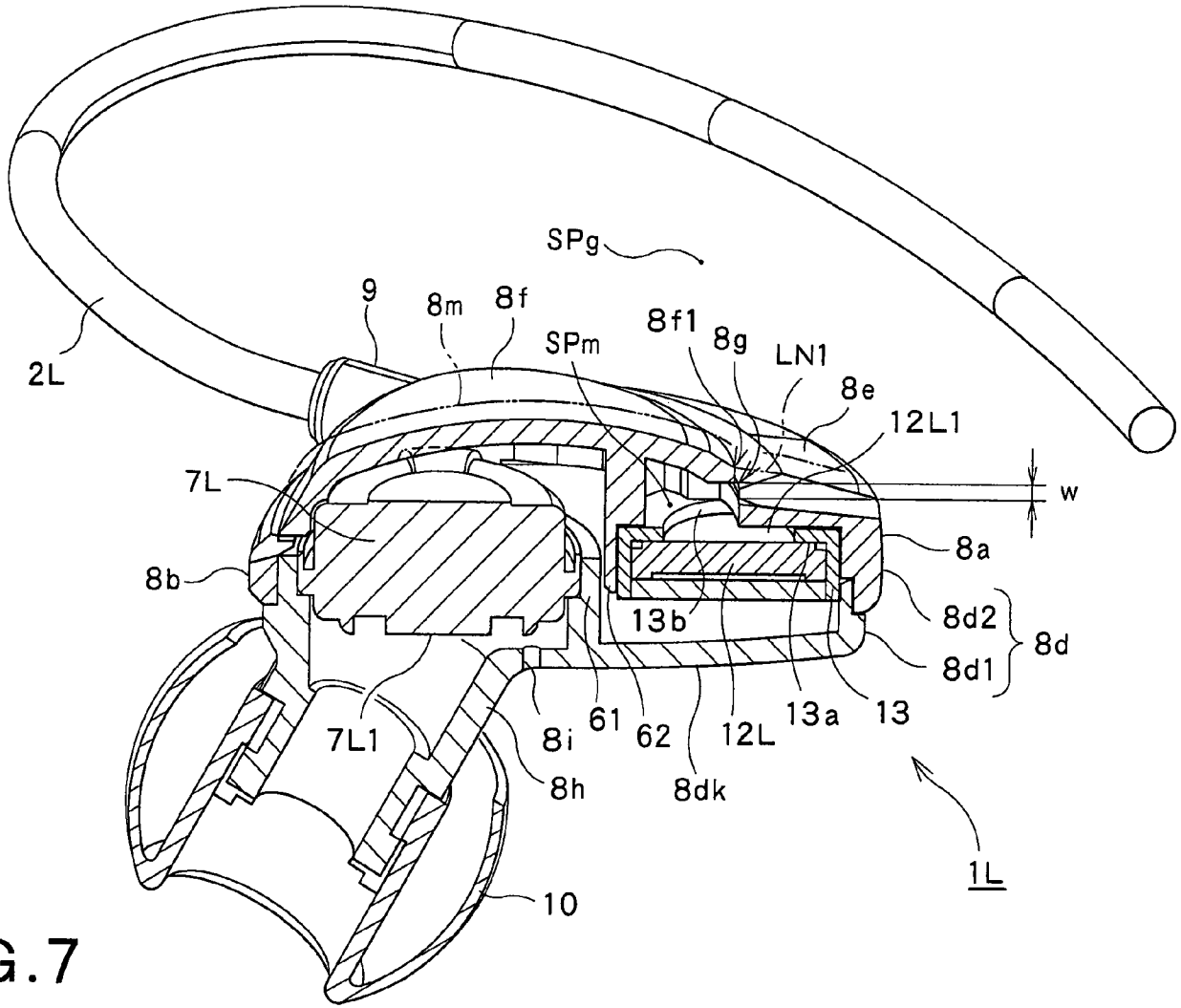
FIG. 7 is a perspective sectional view of the left-ear headphone unit taken on line S1-S1 in FIG. 6, when viewed from DOWN but obliquely in FIG. 6, according to the present invention.

Provided on the main housing 8*d* and in the vicinity of the sound output tube 8*h* is a sound-quality adjusting hole 8*i* that communicates a front space of the speaker 7L (installed in the housing body 8, as shown in FIG. 7) and the outside.

The sounds given off by the speaker 7L is output through the sound output tube 8*h* to the ear canal of the user's left ear.

Figure 5:
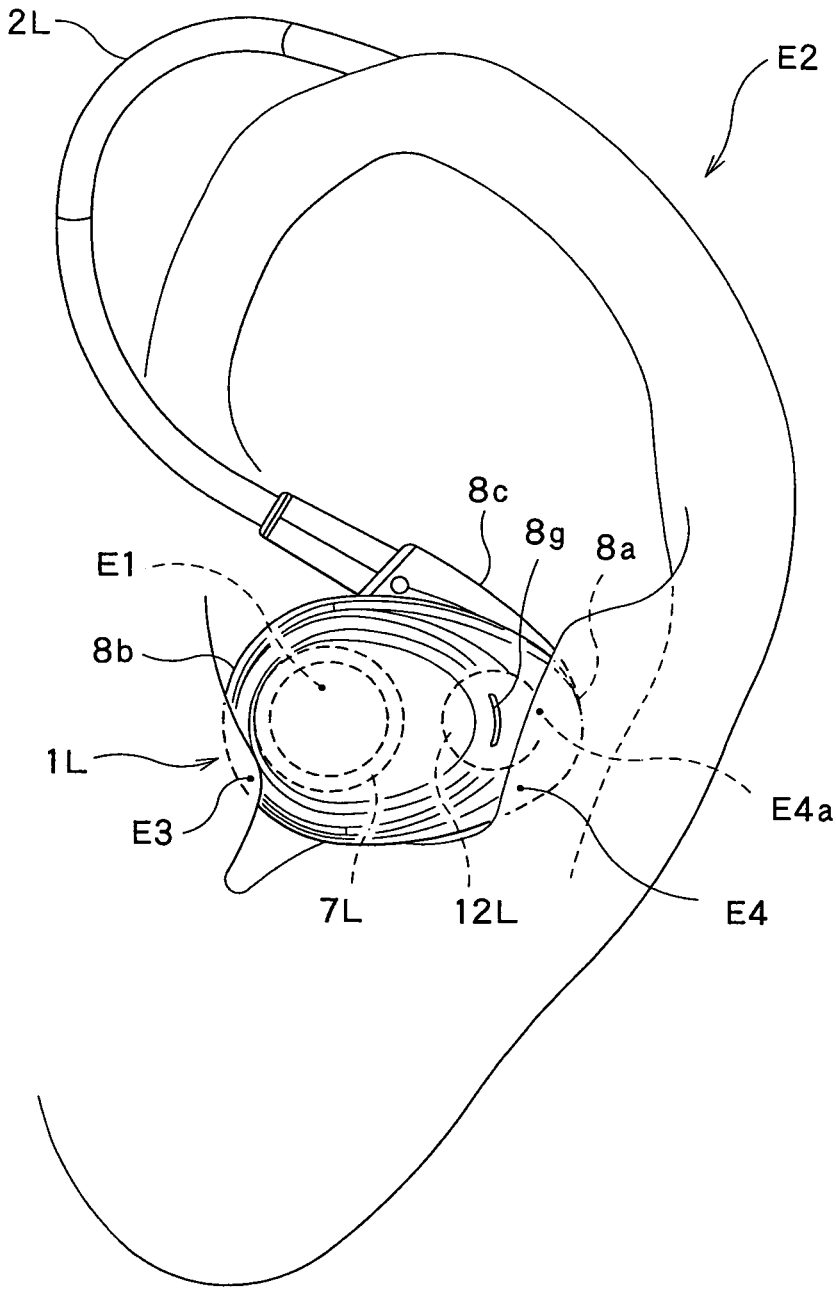
FIG. 5 is an illustration of the left-ear headphone unit attached to the user's left ear, according to the present invention.

Illustrated in FIG. 5 is that the left-ear headphone unit 1L is attached to the user's left ear, with the speaker 7L and the microphone 12L, both indicated with dashed lines, installed in the housing body 8.

As illustrated in FIG. 5, the left-ear headphone unit 1L is attached to an auricle E2 of the user's left ear so that the entire unit 1L is fit in a cavum conchae E1. In detail, the unit 1L is fit in the cavum conchae E1 in such a manner that the large-radius section 8*b* is situated between a tragus E3 and the cavum conchae E1 while the small-radius section 8*a* is touched by an inner wall E4*a* of a helix E4 that faces the tragus E3. The sound pick-up opening 8*g* is provided at a position that is not covered by the helix E4 when the unit 1L is attached to the left ear in the manner described above.

With respect to FIG. 5, one feature of the present invention lies in the arrangement of the speaker 7L and the microphone 12L in the housing body 8. In detail, when the left-ear headphone unit 1L is fit in the cavum conchae E1 of the user's left ear, the speaker 7L and the microphone 12L are aligned between a first plane section and a second plane section (both not shown in FIG. 5) of the housing body 8. The first and second plane sections face each other in the housing body 8. The first and second plane sections are almost perpendicular to the cross section of the cavum conchae E1 of the user's ear when the unit 1L is fit in the cavum conchae E1.

Figure 6:
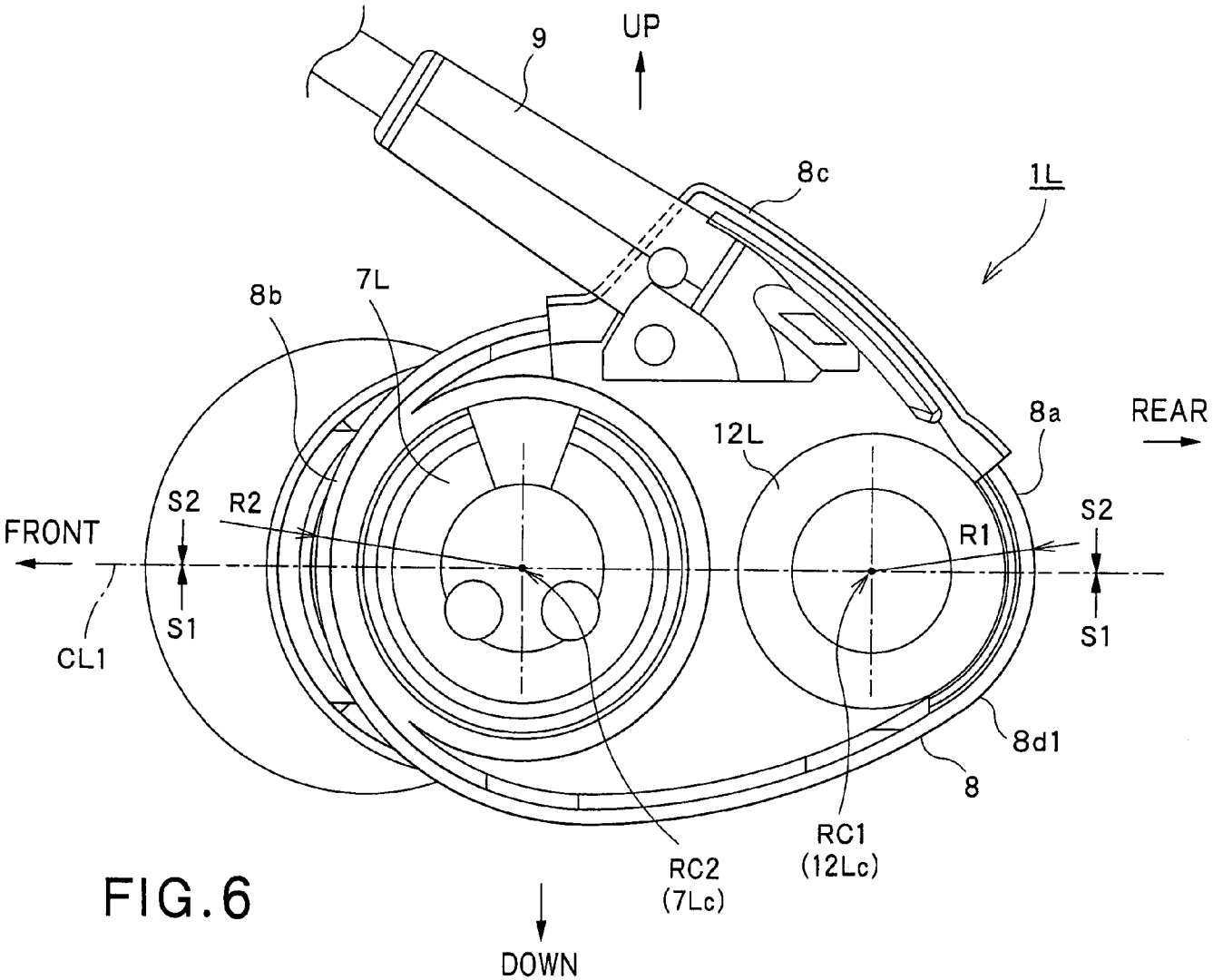
FIG. 6 is a plan view of the left-ear headphone unit when viewed from the direction indicated by an arrow D1 in FIG. 3, showing a speaker and a microphone both installed in a housing body of the left-ear headphone unit, according to the present invention.

Described next with reference to FIG. 6 are the speaker 7L and the microphone 12L both installed in the housing body 8 of the left-ear headphone unit 1L. FIG. 6 is a plan view of the unit 1L when viewed from the direction indicated by the arrow D1 (almost orthogonal to the zone SK) in FIG. 3. The arrows with the signs FRONT, REAR, UP and DOWN indicate the same directions as shown in and defined with respect to FIG. 3.

As shown in FIG. 6, the speaker 7L and the microphone 12L are aligned on a longitudinal axis CL1 of the main housing 8*d*, as arranged on the large-radius section 8*b* side and the small-radius section 8*a* side, respectively. Both have an almost flat cylindrical shape in the plan view of FIG. 6.

In this arrangement, highly efficient inner-space utilization is achieved for the small-radius section 8*a* when the center of the outer curvature of the section 8*a* agrees with the center of the microphone 12L. Likewise, highly efficient inner-space utilization is achieved for the large-radius section 8*b* when the center of the outer curvature of the section 8*b* agrees with the center of the speaker 7L.

In FIG. 6, the center of the outer curvature of the small-radius section 8*a* is a center RC1 with a radius R1 from the center RC1 to the outer-most surface of the section 8*a* in the direction REAR, and the center of the outer curvature of the large-radius section 8*b* is a center RC2 with a radius R2 from the center RC2 to the outer-most surface of the section 8*b* in the direction FRONT.

FIG. 6 shows that a center 12LC of the microphone 12L and a center 7LC of the speaker 7L agree with the curvature centers RC1 and RC2, respectively.

The outer surface of the small-radius section 8*a* having the radius R1 from the center RC1 is preferably a zone through which the longitudinal axis CL1 passes. Likewise, the outer surface of the large-radius section 8*b* having the radius R2 from the center RC2 is preferably a zone through which the longitudinal axis CL1 passes.

The egg-shaped housing body 8 preferably has a large circumference at the front side of the user's head and a small circumference at the rear side of the user's head so that the left-ear headphone unit 1L is fit well in the cavum conchae E1 of the auricle E2, as shown in FIG. 5.

It is thus preferable to arrange the speaker 7L at the FRONT side of the left-ear headphone unit 1L and the microphone 12L having a smaller radius than the speaker 7L at the REAR side of the unit 1L, as shown in FIG. 6, in accordance with the positional relationship between the cavum conchae E1 and the opening of the ear canal of the user's left ear.

Installation of the microphone 12L at the rear side of the left-ear headphone unit 1L is described with reference to FIGS. 7 to 9.

FIG. 7 is a perspective sectional view of the left-ear headphone unit 1L taken on line S1-S1 in FIG. 6, when viewed from DOWN in FIG. 6 but obliquely. FIG. 8 is an enlarged partially perspective sectional view illustrating the microphone 12L and the surrounding components.

Figure 8:
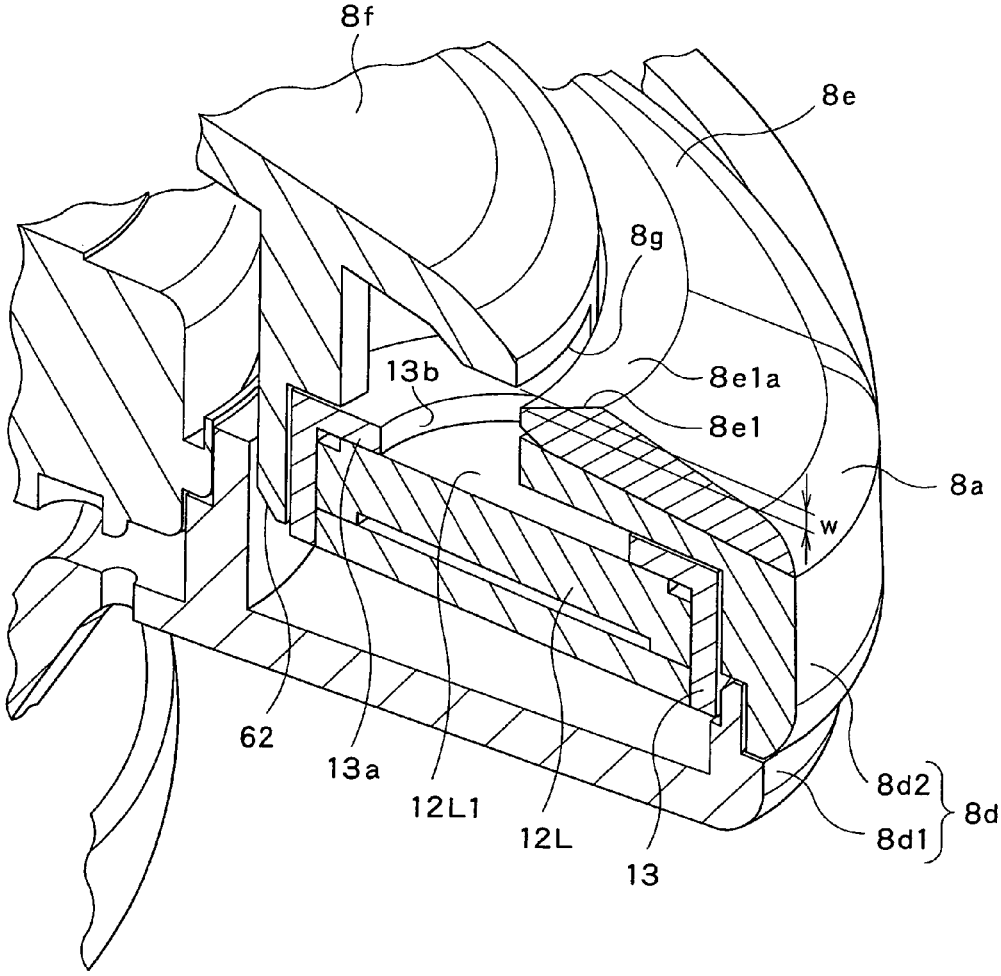
FIG. 8 is an enlarged partially perspective sectional view illustrating the microphone and the surrounding components of the left-ear headphone unit, according to the present invention.

Not shown in FIGS. 7 and 8 for brevity are a pair of lead wires pulled from the rear surface of the speaker 7 that is opposite of a sound output surface 7L1 and another pair of lead wires pulled from the rear surface of the microphone 12L that is opposite of a sound picked-up surface 12L1. The two pairs of lead wires are extended into the cord 2L.

As shown in FIG. 7, the speaker 7L and the microphone 12L are aligned between the base member 8*dk* of the inner housing 8*d*1 and an outer surface 8*m* (indicated by a chain double-dashed line) of the ornament cap 8*f* and the ornament ring 8*e* so that the speaker 7L and the microphone 12L are not overlapped each other in a direction in FIG. 7 in which a width W lies, which will be discussed later.

The speaker 7L is fixed in a circular rib 61 provided in the inner housing 8*d*1. The microphone 12L is attached to a cylindrical holder 13 with an opening at the bottom thereof so that it is tightly fit in the opening.

The holder 13 is made of an elastic material, such as, rubber. The holder 13 is provided at the outer housing 8*d*2 side, as being fixed in a circular rib 62 of the housing 8*d*2. Provided on a top 13*a* of the holder 13 is a circular opening 13*b* exposed through which is at least a part of the sound picked-up surface 12L1 of the microphone 12L.

The outer surface of the speaker 7L is attached tight to the inner circular surface of the circular rib 61 of the inner housing 8*d*1. The holder 13 is attached tight to the circular rib 62 of the outer housing 8*d*2. Moreover, the outer surface of the microphone 12L is attached tight to the inner surface of the holder 13. This tight structure prevents the sounds from the speaker 7L from being picked up by the microphone 12L through the inner housing 8*d*1.

The pick-up opening 8*g* (through which ambient sounds are picked up by the microphone 12L) is provided as a slot between the ornament ring 8*e* and the ornament cap 8*f*, as having the width W in a direction to the user's head when the headphone unit 1L is attached to the user's left ear.

The ornament ring 8*e* is provided with a slant section 8*e*1, as shown in FIG. 8, that inclines towards the inner housing 8*d*1 as it becomes closer to the pick-up opening 8*g*.

With the slant section 8e1, the pick-up opening 8g is opened towards the outside of the housing body 8 from inside thereof, in a direction away from the speaker 7L, with the width W in the direction of the user's head when the headphone unit 1L is attached to the user's left ear, or in the direction parallel to the plane of FIG. 7, and with the arc length L1 (FIG. 3) in a direction perpendicular to the plane of FIG. 7.

As shown in FIG. 7, the left-ear headphone unit 1L is provided with an inner space SPm that is linked to the sound picked-up surface 12L1 of the microphone 12L. The inner space SPm communicates with an ambient space SPg through the pick-up opening 8g.

In FIG. 7, a double-dashed dotted line LN1 indicates the outer surface of the ornament ring 8e, that can be extended as linked to an outer edge section 8f1 of the ornament cap 8f if the pick-up opening 8g is not provided.

However, since the embodiment of the present invention is provided with the pick-up opening 8g and the slant section 8e1, as shown in FIG. 8, the outer surface LN1 of the ornament ring 8e is not linked to the outer edge section 8f1 of the ornament cap 8f.

Figure 9:
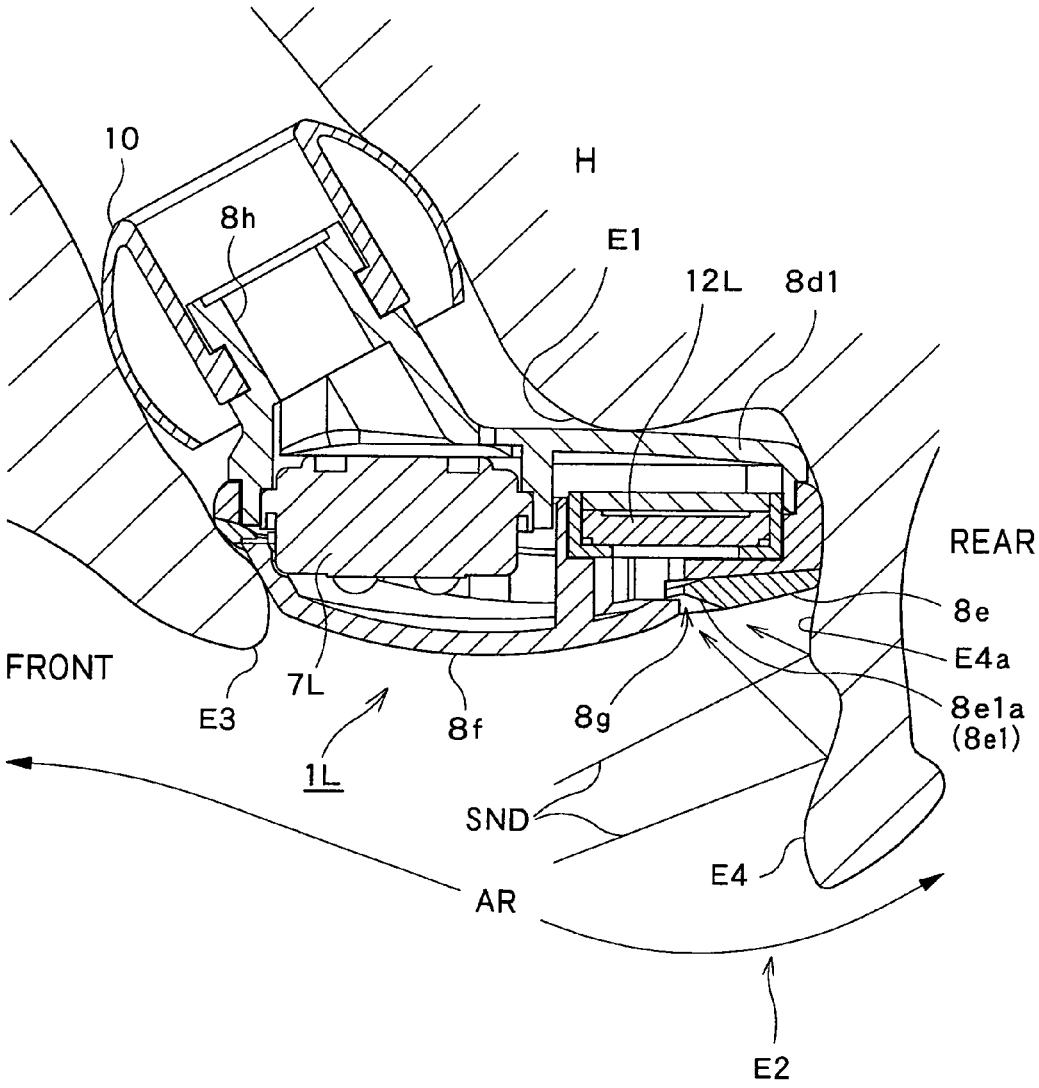
FIG. 9 is a perspective view of the left-ear headphone unit when attached to the user's left ear, according to the present invention.

Discussed further with respect to FIG. 9 are the pick-up opening 8g having the width W in the direction to the user's head, when the headphone unit 1L is attached to the user's left ear, and the slant section 8e1 provided to the ornament ring 8e.

FIG. 9 is a sectional view taken on line S2-S2 in FIG. 6 when the headphone unit 1L is attached to the user's left ear, with an illustration of the auricle E2 of the user's left ear.

As shown in FIG. 9, the slant section 8e1 is provided with a slant surface 8e1a that becomes closer to the inner housing 8d1 (a user's head H) from REAR to FRONT (indicating the same directions as shown in FIG. 3). The slant section 8e1 having the slant surface 8e1a serves well to guide sounds that travel from REAR to the pick-up opening 8g.

The headphone unit 1L is designed such that the small-radius section 8a touches an inner wall E4a of the helix E4 of the auricle E2 when attached to the user's left ear, with the pick-up opening 8g located in the vicinity of the wall E4a due to the installation of the microphone 12L in the section 8a.

The arrangements allow the microphone 12L to pick up sounds through the pick-up opening 8g, which are mostly reflected at the inner wall E4a of the helix E4, as indicated by arrows SND in FIG. 9.

When a user hears sounds with his or her ears, the sounds include those reflected at the inner wall E4a of the helix E4. Thus, the sounds picked up through the pick-up opening 8g are very similar to the sounds which are actually heard by the user with his or her ears.

Therefore, the headphone set 50 according to the present invention shows excellent noise-canceling function, by utilizing the sounds picked up through the pick-up opening 8g.

Concerning the noise-canceling function, the pick-up opening 8g is positioned in the vicinity of the inner wall E4a of the helix E4 and close to the user's head H, as shown in FIG. 9, and thus not affected by winds.

In detail, the winds that flow from REAR of the user's head H to FRONT are mostly prevented by the auricle E2 from reaching the pick-up opening 8g that is located behind the auricle E2 when viewed from REAR. On the other hand, the winds that flow from FRONT of the user's head H to REAR do not produce rapid flows inside the inner wall E4a of the helix E4 because the wall E4a functions as a protective wall. Mainly, winds flow along a path AR and thus hardly produce rapid flows in the vicinity of the pick-up opening 8g.

The mechanism described above can restrict wind noises at the pick-up opening 8g very well, which serves to improve the quality of sounds reproduced by the headphone set 50, according to the present invention, with excellent noise-canceling function.

As described above, the headphone set 50 is equipped with the speaker 7L and the microphone 12L as aligned in the headphone unit 1L as almost parallel to (or along) the user's head H, as shown in FIG. 9, thus the headphone unit 1L becomes thinner.

The thin headphone unit 1L does not protrude from the auricle E2 of the user's ear so much so that the sound pick-up opening 8g provided to the unit 1L, as described above, can reduce effects of wind noises to the sound reproduction and noise-canceling function.

The egg-like headphone unit 1L is fit well inside the auricle E2 of the user's ear due to the location of the small- and large-radius sections 8a and 8b at the rear and front sides, respectively, of the user's head, when attached to his or her ear.

The pick-up opening 8g is provided as having the width W in the direction to the user's head when the headphone unit 1L is attached to the user's left ear, as described with respect to FIG. 7. And, the ornament ring 8e is provided with the slant section 8e1 that inclines towards the inner housing 8d1 as it becomes closer to the pick-up opening 8g, as described with respect to FIG. 8, which opening 8g is positioned in the vicinity of the inner wall E4a of the helix E4 when the unit 1L is attached to the user's left ear.

The arrangements allow the sounds reflected at the helix E4 of the auricle E2 of the user's ear to be guided to the pick-up opening 8g so that sounds very similar to those heard through his or her ear can be picked up through the opening 8g, thus achieving excellent noise canceling function.

One requirement in design of the left-ear headphone unit 1L (and also the right-ear headphone unit 1R) lies in the distance between a first end and a second end of the housing body 8, with the large- and small-radius sections 8b and 8a being provided at the first and second ends, respectively.

In detail, the distance between the first and second ends of the housing body 8 is determined so that, when the housing body 8 is fit in the cavum conchae E1 of the user's ear, the large-radius section 8b is situated between the tragus E3 of the user's ear and the cavum conchae E1 while the small-radius section 8a is touched by the inner wall E4a of the helix E4 of the user's ear.

The pick-up opening 8g must be designed with well balanced sizes concerning the arc length L1 (FIG. 3) and width W (FIGS. 7 and 8), too small sizes causing unstable phase of picked-up sounds while large sizes suffering wind noises.

It is further understood by those skilled in the art that the foregoing description is a preferred embodiment of the disclosed apparatus and that various changes and modifications may be made in the present invention without departing from the sprit and scope thereof.

For example, the present invention is applicable not only to the canal type but another type in the inner-ear type headphone sets, with a plurality of sound-output holes on the base member 8dk (FIG. 4).

Moreover, the headphone set according to the present invention may not only be the type having the noise-canceling function but also a microphone-equipped headphone set having a speaker through which sounds are given off to a user' ear and a microphone through which user's voices are output.

According to the present invention, such a microphone-equipped headphone set can also be fit well inside the auricle of a user's ear, with wind noises being restricted around the microphone, as discussed above.

As described above in detail, the present invention achieves high fitability to auricles of user's ears with almost no effects of wind noises for an inner-ear type headphone set equipped with a microphone, installed in a headphone housing, to pick up ambient sounds.

What is claimed is:

1. A headphone set comprising:

a housing body having a first housing section and a second housing section that faces the first housing section, the first and second housing sections being almost perpendicular to a cross section of a cavum conchae of a user's ear when the housing body is fit in the cavum conchae;

a speaker and a microphone aligned between the first and second housing sections;

a sound output section provided at the first housing section, to give off sounds output by the speaker to an outer space of the housing body;

a sound pick-up hole provided at the second housing section, through which the outer space communicates with an inner space of the housing body created between a sound pick-up section of the microphone and the second housing section;

wherein the speaker and the microphone are aligned between the first and second housing sections in a longitudinal direction of the housing body, the housing body having a first end at which side the speaker is located and a second end at which side the microphone is located, wherein the first end is provided as an arc-like large-radius section having a first radius and the second end is provided as an arc-like small-radius section having a second radius that is smaller than the first radius, and wherein the speaker has an almost flat cylindrical shape with a first center and the microphone has an almost flat cylindrical shape with a second center, the first and second centers agreeing with centers of the first and second radii, respectively.

2. The headphone set according to claim 1, wherein the housing body has an inner housing and an outer housing, the inner housing being closer than the outer housing to a user's ear when the housing body is fit in a cavum conchae of the user's ear, wherein the outer housing has a slant section that inclines towards the inner housing as the slant section becomes closer to the pick-up opening in which, with the slant section, the pick-up opening opens in a direction away from the speaker.

3. The headphone set according to claim 1, wherein a distance between the first and second ends is determined so that, when the housing body is fit in the cavum conchae, the large-radius section is situated between a tragus of the user's ear and the cavum conchae while the small-radius section is touched by an inner wall of a helix of the user's ear.

4. The headphone set according to claim 1, wherein the sound pick-up hole is positioned so that, when the housing body is fit in the cavum conchae, the sound pick-up hole faces the inner wall of the helix.

5. The headphone set according to claim 1, wherein the speaker is located at the first housing section side and the microphone is located at the second housing section side.

6. A headphone set comprising:

a housing body having a first housing section and a second housing section that faces the first housing section, the first and second housing sections being almost perpendicular to a cross section of a cavum conchae of a user's ear when the housing body is fit in the cavum conchae;

a speaker and a microphone aligned between the first and second housing sections;

a sound output section provided at the first housing section, to give off sounds output by the speaker to an outer space of the housing body;

a sound pick-up hole provided at the second housing section, through which the outer space communicates with an inner space of the housing body created between a sound pick-up section of the microphone and the second housing section;

wherein the speaker and the microphone are aligned between the first and second housing sections in a longitudinal direction of the housing body, the housing body having a first end at which side the speaker is located and a second end at which side the microphone is located;

a plug to be connected to an audio output terminal of an external audio apparatus; and a noise canceller to generate a first audio signal having a reverse phase of a second audio signal generated by the microphone based on sounds picked up by the microphone through the sound pick-up hole, and add the first audio signal to a third audio signal supplied to the noise canceller from the external audio apparatus via the plug, the third audio signal being supplied to the speaker.

7. The headphone set according to claim 6, wherein the first end is provided as an arc-like large-radius section having a first radius and the second end is provided as an arc-like small-radius section having a second radius that is smaller than the first radius, and a distance between the first and second ends is determined so that, when the housing body is fit in the cavum conchae, the large-radius section is situated between a tragus of the user's ear and the cavum conchae while the small-radius section is touched by an inner wall of a helix of the user's ear.

8. The headphone set according to claim 6, wherein the sound pick-up hole is positioned so that, when the housing body is fit in the cavum conchae, the sound pick-up hole faces the inner wall of the helix.

9. The headphone set according to claim 3, wherein the speaker is located at the first housing section side and the microphone is located at the second housing section side.

* * * * *